US006201515B1

(12) United States Patent
Sperber et al.

(10) Patent No.: US 6,201,515 B1
(45) Date of Patent: Mar. 13, 2001

(54) METHOD AND APPARATUS FOR PRODUCING AN ANTENNA REFLECTOR, AND A STRUCTURE FOR SUCH A REFLECTOR

(75) Inventors: Franz Sperber, Kolbermoor; Martin Roth, Taufkirchen; Jürgen Dupier, Velden/Vils, all of (DE)

(73) Assignee: Daimler Chrysler AG., Stuttgart (DE)

( * ) Notice: Subject to any disclaimer, the term of this patent is extended or adjusted under 35 U.S.C. 154(b) by 0 days.

(21) Appl. No.: 09/298,660

(22) Filed: Apr. 23, 1999

(30) Foreign Application Priority Data

Apr. 23, 1998 (DE) ..... 198 18 241

(51) Int. Cl.[7] ..... H01Q 21/12
(52) U.S. Cl. ..... 343/912; 29/600
(58) Field of Search ..... 343/912, 897, 343/895; 29/600, 601, 425, 416

(56) References Cited

U.S. PATENT DOCUMENTS 4,092,453 * 5/1978 Jonda ..... 428/255
5,488,383 1/1996 Friedman et al. ..... 343/912

* cited by examiner

*Primary Examiner*—Don Wong
*Assistant Examiner*—Trinh Vo Dinh
(74) *Attorney, Agent, or Firm*—Ladas & Parry

(57) ABSTRACT

A method for the production of a reflector for antennas to be used in outer space in which a thread (7) is wound on a winding spindle (1), to obtain a netting or network structure. The winding spindle (1) has contour segments (2) on its surface, whose contour corresponds to the contour of a sector of the reflector surface being produced. After winding, the resulting thread network structure is hardened on the winding spindle (1) and the thread network structure is divided into individual sections. The contour segments (2) are separated from the winding spindle (1) and together with the sections of the hardened network structure thereon are fitted together on an assembly rig so that the individual sections collectively form a reflector. The winding of the thread of the network structure on the spindle can vary in at least one direction or in its angle of placement a, so that the network structure has a different, selectable rigidity in individual areas.

20 Claims, 1 Drawing Sheet

METHOD AND APPARATUS FOR PRODUCING AN ANTENNA REFLECTOR, AND A STRUCTURE FOR SUCH A REFLECTOR

FIELD OF THE INVENTION

The invention relates to reflectors such as used for antennas and particularly to a method and apparatus for producing such reflectors.

The invention also relates to the construction of such reflectors and particularly to individual reflector segments formed by a hardened thread net wound on a contour segment.

BACKGROUND AND PRIOR ART

Reflectors or antenna reflectors are used in outer space for communication purposes. They have a surface which follows the contour of a hyperbola or parabola. Accordingly, they have a double-curved surface. Effective and accurate operation requires that the surface have a substantially exact curvature.

Conventional reflectors have a netting or a network structure of composite fiber material as the reflector surface. In a conventional procedure, the reflector surface is fabricated by laying a thread in such a way as to produce a network structure. The laying of the thread is effected on a flat support, for example, by a thread laying robot. Next, the preliminary structure is transferred to the desired contour surface, for example, a parabolic surface which has a double curvature.

The known manufacturing method, however, has the drawback that a deformation of the structure occurs when the preliminary structure is transferred from a planar support or from a single-curved support, such as a winding spindle, to the double-curved contour surface. Furthermore, stresses are induced in the structure and the network surface becomes distorted. The network structure is also distorted or deformed when the network structure is first fabricated on a winding spindle and then transferred to the contour surface. Therefore, the reflector surfaces produced by the conventional manufacturing processes have an imprecise contour, which deviates from the ideal shape. In addition, surface imperfections such as dents or the like may arise from stresses in the reflector surface.

Furthermore, especially in the case of reflectors which are folded for purpose of transport into orbit and deployed upon reaching their station in outer space, the problem arises that additional stresses are induced by virtue of differing degrees of curvature in different regions of the deployed reflector surface. This contributes to further distortion of the network surface, especially when in use over a long time.

SUMMARY OF THE INVENTION

An object of the present invention is therefore to provide a method and apparatus for making a reflector, by which the accuracy of the reflector surface is enhanced and stresses or deformations of the reflector surface are avoided. Furthermore, a network structure is produced that serves as a reflector surface and is substantially free from stresses.

The method according to the invention for making a reflector comprises the steps of:

winding a thread on a winding spindle to obtain a thread network structure on the spindle, the winding spindle having contour segments on its surface, whose contour corresponds to the contour of a segment of a surface of the reflector being produced;

hardening the thread network structure on the winding spindle;

dividing the network structure into individual segments; and assembling the individual segments to form the reflector.

By virtue of the method of the invention, a reflector is produced with a reflector surface that is substantially free of stress in the operating condition and has a highly accurate contour.

In advantageous manner, after the dividing of the thread network structure the contour segments are separated from the winding spindle, each carrying a single segment of the thread network structure. Preferably, the single segments of the thread network structure are in contact with the contour segments of the winding spindle or are supported by the latter when being assembled to form the reflector. The means that the individual elements of the reflector remain in their original shape from fabrication until final assembly.

Preferably, the laying angle of the thread is varied when winding the thread on the spindle. In this way, the stiffness of the individual segments can be adapted to local requirements. Preferably, the thread tension is regulated during the winding, so that a tension in network can be obtained to satisfy particular requirements.

A stiffening structure, especially one in the form of ribs, can be arranged on the network structure while said structure is located on the winding spindle. In this way, an additional stabilization of the reflector surface is achieved. Preferably, the thread is made of carbon fibers and/or HT fiber. This ensures that little or no contour change occurs during temperature fluctuations and, due to its low E-modules, easier curvature is accomplished. The fiber can be impregnated and soaked in synthetic resin prior to the winding operation.

Several winding spindles can be placed in a row in the lengthwise direction. In this way, the reflectors can be fabricated in an especially efficient manner, since there is minimization of the reversal mechanism.

The device according to the invention for making the reflector comprises a winding spindle including a central body, a detachable contour segment on said central body onto which a thread can be wound to form a sector of a reflector, said contour segment having a double-curvature surface whose contour corresponds to the sector of the reflector such that a plurality of said sectors can be assembled to obtain the reflector.

Preferably, a plurality of contour segments are advantageously arranged to extend radially outwards from a center of the reflector adjacent to one another circumferentially around the reflector. Positioning elements, in the form of pins, can be arranged on the segments to assure a precise positioning of the segments to form the reflector surface.

According to yet another aspect of the invention, a network structure for reflectors is provided, especially for antennas in outer space, in which an angle of winding the thread of the thread network is varied so that the network structure has a different, selectable rigidity in individual areas. In this way, it is possible to equalize stresses and prevent buckling of the reflectors due to the different radii of curvature in different areas of the reflector.

In advantageous manner, the network structure of the invention constitutes a segment of a reflector surface Thus, it is e specially suitable for the fabrication of a high-precision deployable reflector.

DETAILED DESCRIPTION

Figure 1:
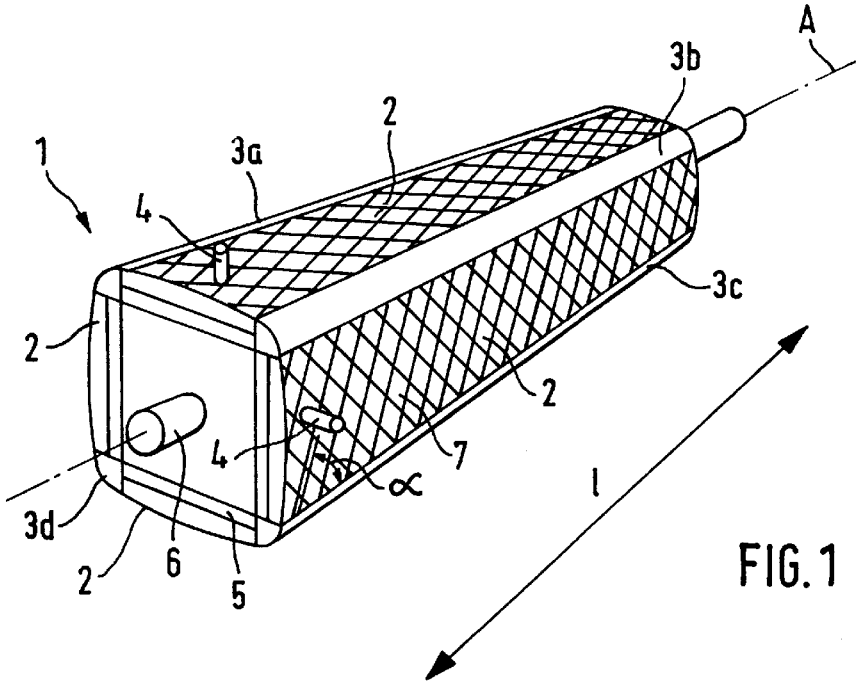
FIG. 1 is a diagrammatic illustration of a winding spindle on which a thread is wound to form a network structure which can be divided into individual segments.

FIG. 1 shows the device according to the invention which comprises a winding spindle 1, which has detachable contour segments 2 on its surface. The outer surface or contour of the contour segments 2 corresponds to the contour of a segment of a reflector surface being produced. The contour segments 2 are each held between two struts 3*a*, 3*b* or 3*b*, 3*c*, which extend in the lengthwise direction of the winding spindle and are part of a central body or a holding device to secure the contour segments.

In the preferred embodiment illustrated in FIG. 1, four contour segments 2 are arranged circumferentially around the spindle. On each of the contour segments 2 there are positioning pins 4, which serve for precise positioning of the individual segments when they are assembled together to form a reflector surface. The contour segments 2 have a double-curved surface generally parabolic, but which can be chosen according to the particular requirements of the reflector surface being made. The detachable contour elements 2 can be easily exchanged, so that the device can easily be adapted to other specifications regarding the reflector surface being made.

The longitudinal struts 3*a*, 3*b*, 3*c*, 3*d* of the central body are joined together by transverse struts 5, which are located at the ends of the winding spindle. Thus, each contour element or segment 2 is held by an essentially rectangular or trapezoidal frame consisting of a pair of transverse struts 5 and a pair of longitudinal struts 3*a–d*.

The winding spindle 1 is rotatable on a shaft 6, so that a thread 7 can be wound by turning the spindle 1. The axis of rotation A of the spindle lies at the center of the spindle 1 in its lengthwise direction.

Figure 2:
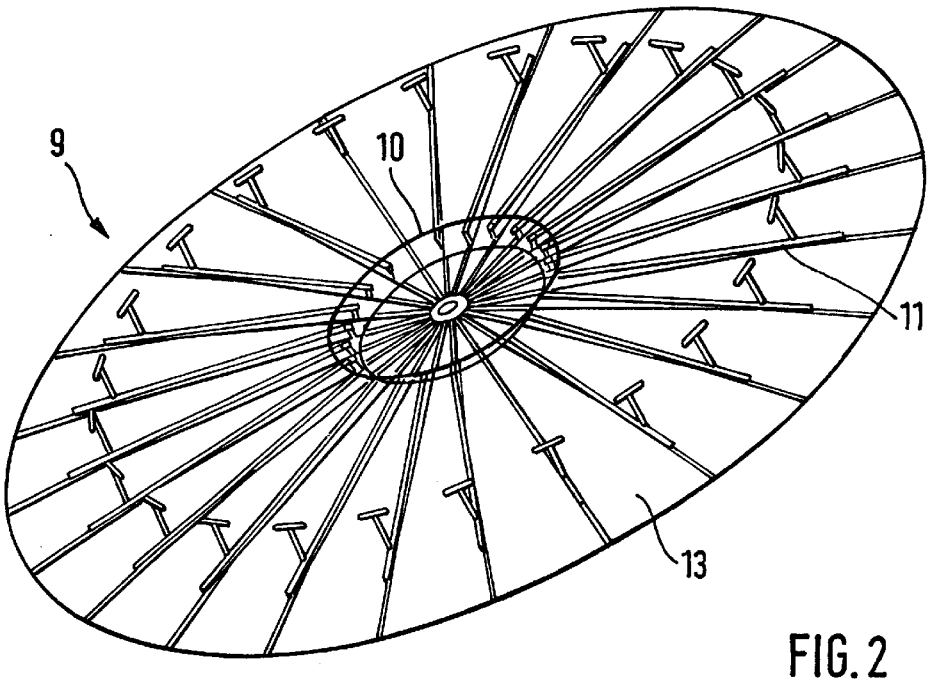
FIG. 2 shows a deployed reflector, which has the network structure of the invention constituted as segments thereof.

Hereafter, the production of a reflector 9, as represented in FIG. 2, shall be described by reference to FIG. 1. First, a thread 7 is wound on the spindle 1. In this process, the winding spindle 1 turns around the lengthwise axis A and a thread dispenser (not shown) is moved back and forth along the length I of the spindle 1. The thread 7 consists of carbon fiber, which is very thernostable, i.e., has little of no deformation with respect to temperature fluctuations. A very good curvature can be achieved by using an HT fiber, due to its low E-modulus.

In order to enhance the electrical conductivity, a copper wire can be introduced during the winding or a mesh can be placed directly on the spindle surface.

The advancement of the thread dispenser along the winding spindle 1 is guided such that the angle of placement a of a thread 7 on the contour segments 2 varies. This is accomplished by different thread feeding rates. By changing the angle of placement $\alpha$ of the thread 7, the network structure obtained is given a variable rigidity in different areas. The rigidity is chosen so that it is less in areas of large curvature as compared to areas of small curvature. This also allows for the necessary curvature when folding the network structure, if the network structure is used as a reflector surface of a folding type reflector.

The thread tension likewise can be regulated during the winding, in order to accomplish a stable or uniform baseline tension value for the network. The thread nodes or overlaps can be adhesively joined together and, for further compaction, a foil can be placed or wound on the network structure still on the winding spindle 1.

After the winding, the network structure is hardened on the winding spindle 1. For this purpose, the thread 7 is soaked or impregnated with synthetic resin prior to the winding and the synthetic resin is hardened, in situ, after the winding. The hardening is done by heating the entire winding spindle 1 with the thread 7 thereon. Other heating methods can also be used, such as by placing a matrix of hardenable material on the network structure while it is located on the winding spindle 1.

After the hardening of the network structure on the winding spindle 1, any additional structures for the reflector are mounted thereon. In the case of a deploying reflector, the additional structures include ribs 11 (see FIG. 2), which extend radially outward from the center of the reflector 9 along the reflector segments on the back side thereof. The structures serve, for example, to support the reflector surface of the finished reflector 9.

The network surface or network structure, thus far consisting of a single piece, is now divided into individual segments, by cutting the thread network along the lengthwise struts 3*a*–3*d* of the winding spindle 1.

The resulting individual segments of the network structure are now assembled together on a support to produce a complete reflector. The assembly is effected on a rig (not shown). Hence, the individual elements or single segments of the reflector surface remain in contact with the contour segments 2 of the winding spindle 1, which represent their particular original form, from the production of the network structure until the combined reflector is finally assembled after which the contour segments are removed for possible re-use.

In an especially preferred embodiment, the above-mentioned ribs 11 or additional structure which are mounted on the network surface after the hardening, are joined to the segments of the network structure by foil links. During the assembly process, the single segments which are each held between two ribs 11 by the foil links are joined together by connecting every two adjacent ribs 11, so that the single segments form a continuous reflector surface.

The positioning pins 4 arranged on the contour elements serve for exact positioning of the individual segments of the network structure together with the contour segments 2 on the assembly rig. This enables an exact fitting of the segments together, yielding high surface precision of the reflector 1 being produced.

In another preferred embodiment, several winding spindles 1 are placed in end to end relation in the lengthwise direction. In this way, many surface segments of a reflector surface can be made with a high degree of automation. In this case, the thread dispenser travels along an entire row of winding spindles 1 connected in succession during a winding operation.

The network structure produced by the method of the invention is suitable for reflectors, especially antenna reflectors for use in outer space. However, the network structure can also be used as a mirror, for example, for energy production. The network structure can have a surface coating suitable to the particular application. The placement of the network thread 7 varies in at least one direction in the network structure, i.e., it is oriented at different angles of placement a relative to a segment edge. Due to this variation, the network structure has differing rigidity in certain areas, as determined by the angle of placement or the direction of laying, as chosen according to the particular requirements imposed on the network structure. In the described embodiment, the single segment formed for the network structure is a segment of a reflector surface, which can be combined with other segments to make a combined reflector surface.

FIG. 2 shows a reflector 9 that is produced by the method and apparatus of the invention. It has an additional structure on its back side, consisting of a rigid central piece 10 and ribs 11 extending radially outward. The reflector surface can fold like an umbrella, and the ribs 11 in the folded condition extend parallel to each other proceeding in the same direction from the margin of the central piece 10.

The reflector surface is divided into twenty four single segments 13 and is supported by the rib structure arranged in the shape of a star on the back side of the reflector surface. The reflector surface is free of tension in the unfolded condition and has differing degrees of curvature in different regions. The rigidity of the reflector surface is adapted to the respective requirements depending on the radius of curvature and the folding/unfolding process.

In order to form a large reflector, individual umbrella-deploying reflectors 9 are arranged radially around a central reflector. Special requirements on the precision of the individual segments of the subreflectors obtain for such a large reflector. Furthermore, the surface contour of the individual segments must be designed such as to yield a precise reflector surface for the combined reflector. The individual segments or reflectors have the network structure according to the invention and are produced by the method of the invention as described above.

In addition to the above-described advantages, the method and the device of the invention provide a good and precise reproducibility of the individual segments 13 and of the reflector surface with a high degree of automation and high precision, even for large reflectors or antennas to be used in outer space. Time and money are saved by the easy handling.

The network structure forms a stress-free, permanent and high-precision reflector surface.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. A method for producing a reflector, comprising:

providing a winding spindle having a plurality of contour segments arranged around an axis of rotation of the spindle to form an outer surface of the spindle, said segments having contours corresponding to respective contours of segments of a surface of the reflector being produced;

winding a thread on the winding spindle to obtain a network structure of the thread on the contour segments of the spindle;

hardening the thread on the winding spindle to for mathread network on the contour segments;

dividing the network into individual segments having surface contours corresponding to the contours of said contour segments; and assembling the individual segments to collectively form the reflector.

2. The method as claimed in claim 1, wherein the individual segments are separate from one another after being divided.

3. The method as claimed in claim 1, wherein said individual segments are assembled together by connecting the contour segments of the winding spindle with one another.

4. The method as claimed in claim 1, comprising winding said thread on the contour segments at varying angles lengthwise of the spindle.

5. The method as claimed in claim 1, comprising winding said thread on the contour segments with different thread tension lengthwise of the spindle.

6. The method as claimed in claim 1, comprising mounting a reinforcing structure on the network structure.

7. The method as claimed in claim 1, wherein the thread is made from carbon fiber of HT fiber.

8. The method as claimed in claim 7, comprising impregnating said thread with a synthetic resin to enable the thread to be hardened.

9. The method as claimed in claim 1, wherein a plurality of spindles are arranged end to end in a lengthwise direction and the thread is successively wound on the plurality of spindles.

10. The method as claimed in claim 1 wherein said dividing the network into individual segments is effected while said network is on said winding spindle.

11. The method as claimed in claim 10 comprising separating said individual thread segments from the spindle together with their respective contour segments whereafter said individual thread segments are assembled together while still on said contour segments.

12. The method as claimed in claim 10, wherein each said contour segment extends longitudinally along the axis of rotation of the spindle and partially around the outer surface of the spindle, said thread network on the contour segments being divided by longitudinally separating the individual thread segments on the contour segments from one another and said assembling of said individual segment is effected by joining one thread segment to another along longitudinal separation edges thereof.

13. Apparatus for producing a reflector comprising a winding spindle including a central body, a contour segment on said central body onto which a thread is wound to form a sector of a reflector, said contour segment being detachably mounted on said central body, said contour segment having a double-curvature surface whose contour corresponds to the sector of the reflector such that the thread sector wound on the contour segment takes the double curvature shape of the contour segment and the reflector is formed by assembling a plurality of said thread sectors together.

14. The Apparatus as claimed in claim 13, wherein said contour segment has a parabolic surface.

15. The Apparatus as claimed in claim 13, wherein a plurality of said contour segments are arranged around an axis of rotation of said spindle.

16. The Apparatus as claimed in claim 13, wherein said contour segments include positioning elements for accurately assembling one sector to another.

17. The Apparatus as claimed in claim 10, wherein a plurality of said contour segments are disposed around said winding spindle.

18. The apparatus as claimed in claim 13, wherein said central body comprises longitudinal and transverse struts, said contour segment being detachably connected to said struts.

19. The apparatus as claimed in claim 13, wherein said contour segment extends longitudinally along said central body and partially therearound.

20. A reflector suitable for use in outer space comprising a plurality of reflector segments assembled to form a reflector with a double curvature surface, each reflector segment having a surface contour of double curvature forming part of the double curvature surface of the reflector, each reflector segment comprising a thread network formed by winding a thread on a support having a double curvature corresponding to the double curvature of the respective reflector segment, said thread network having selective areas of differing rigidity obtained by variation of thread placement in said thread network which comprises a variation of angle of winding of the thread on said support during formation of the thread network.

* * * * *

UNITED STATES PATENT AND TRADEMARK OFFICE

CERTIFICATE OF CORRECTION

PATENT NO. : 6,201,515 B1
DATED : March 13, 2001
INVENTOR(S) : Franz Sperber et al.

It is certified that error appears in the above-identified patent and that said Letters Patent is hereby corrected as shown below:

Title page,
Item [73], "Daimler Chrysler AG., Stuttgart" should read -- Astrium GmbH, Munchen --.

Signed and Sealed this

Sixth Day of August, 2002

*Attest:*

*Attesting Officer*

JAMES E. ROGAN
*Director of the United States Patent and Trademark Office*